United States Patent [19]

Delonghi

[11] Patent Number: 4,634,002

[45] Date of Patent: Jan. 6, 1987

[54] BOTTLE CARRIER

[75] Inventor: Adriano G. A. Delonghi, Nuevo Leon, Mexico

[73] Assignee: Fabricacion de Maquinas, S.A., Col. Del Prado, Mexico

[21] Appl. No.: 722,781

[22] Filed: Apr. 12, 1985

[30] Foreign Application Priority Data

Apr. 23, 1984 [MX] Mexico ..... 201,107

[51] Int. Cl.[4] ..... B65D 71/00; B65D 70/04

[52] U.S. Cl. ..... 206/158; 206/151; 206/161; 206/427

[58] Field of Search ..... 206/158, 151, 161, 427; 294/87.2, 87.28

[56] References Cited

U.S. PATENT DOCUMENTS

| | | | |
|---|---|---|---|
| 3,073,644 | 1/1963 | Baker et al. | 206/158 |
| 3,387,879 | 6/1968 | Wood | 206/158 |
| 4,318,476 | 3/1982 | Wood et al. | 206/158 |
| 4,360,231 | 11/1982 | Bolin | 206/158 |
| 4,484,774 | 11/1984 | Moss | 206/158 |
| 4,523,677 | 6/1985 | Schurmann | 206/158 |

FOREIGN PATENT DOCUMENTS

| | | | |
|---|---|---|---|
| 6412069 | 12/1964 | Netherlands | 206/158 |

*Primary Examiner*—Joseph Man-Fu Moy

*Attorney, Agent, or Firm*—Abelman, Frayne, Rezac & Schwab

[57] ABSTRACT

An integrally formed plastic carrier for supporting a plurality of containers by their necks and shoulders, separately and independently of each other, includes a flat plate having a plurality of circular apertures for receiving a container by the shoulder. Each aperture includes an upwardly extending circular wall and a series of bands which connect with a smaller upper ring. A plurality of container supporting tabs project upwards from the upper ring in order to retain each container by its neck.

2 Claims, 6 Drawing Figures

FIG. 3
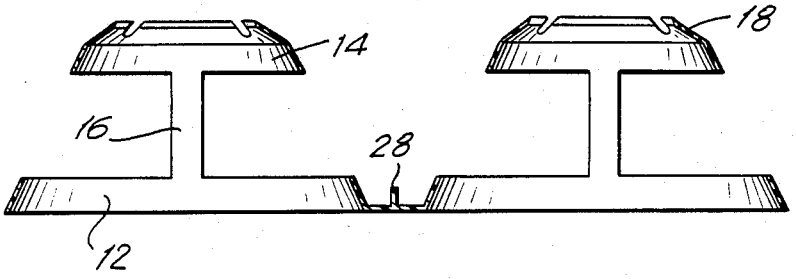
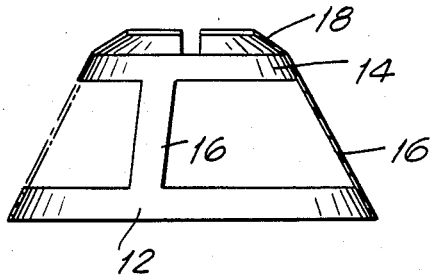
FIG. 4

BOTTLE CARRIER

BACKGROUND OF THE INVENTION

In the last years, the bottling industry has used for the packing of its products a series of plastic carriers which introduce bottled beverages to the consumer in non-returnable six pack receptacles.

The majority of the bottle carriers that can be found in the market have been designed to hold the bottles by the neck, such as is shown by U.S. Pat. No. 3,084,792. This bottle carrier is made up of a flat plastic material which includes a series of openings which receive the upper part of the bottle; an elastic band that is formed integrally in the bottle carrier by a circular band which is connected to the aforementioned bottle carrier by weak connectors that are easily detached and which join the bottle carrier and the band. The cited band serves to maintain the bottle holder and the band joined and at the same time surround and hold the bottles in the said bottle carrier.

Another type of bottle carrier is described by U.S. Pat. No. 3,633,962 which supports the bottles by their neck. The said bottles can be locked into and removed from a plurality of uniforming spaced split bottleneck receiving collars, each mounted within an individual frame interconnected with the other individual frames within the confines of an outer frame.

A third example of bottle carriers is covered by U.S. Pat. No. 4,365,835 which includes a frame that has a series of openings on the same and is surrounded by a series of cylindrical segments-that are adapted to receive, hold and set free a bottle by its-neck. Each one of the said openings includes a portion that has a wide and a narrow pitch.

As can be seen from the previous descriptions there are several types of bottle carriers. However, one of the principal problems that is inherent in all of the bottle carriers described is the fact that the bottles scrape against each other when they are being transported.

As can be seen, with the known bottle carriers the bottles are held by the neck through the use of a band or a surrounding-edge that holds all of them. Consequently at the time that they are transported by the user the bottles nock against each other with occasional breakage.

Another problem found with the known bottle carriers is the fact that some have quite a complicated configuration and this has as a result a high cost.

Taking into account the previous art on bottle carriers it become clear that there is a need for a bottle carrier that has a simple form and that is easily adaptable to support with sufficient firmness several beverage bottles from the neck and the middle. The bottle carrier should be support the bottles-independent of each other. This new bottle carrier must have a lower cost and offer greater carrying safety.

This type of bottle carrier is generally made up of: a supporting frame which includes a pair of finger openings on the mentioned frame which serve as a handle. Six rings are integrated in opposing pairs on the edge of the structure which can be-adapted to independently fasten each bottle by its shoulder; a-second group of rings with a smaller diameter than the ones described above which include a series of flexible notched projections on their top part are used to receive and hold the neck of each bottle; and at least a pair of holding bands which interconnect each primary and secondary rings, thus forming a rigid structure which firmly holds each one of the bottles by the neck and shoulder, independently of each other.

SUMMARY OF THE INVENTION

Therefore, the principal object of the present invention is to provide a carrier that can hold bottles or similar articles and which can serve to receive and hold several bottles by the-neck and shoulder, and both holding devices be independent of each other.

Likewise, another object of the present invention is to provide a carrier to hold bottles or similar articles which offers a greater safety "bottle holding" factor.

A third object of the present invention is to provide a carrier for holding bottles or similar articles which includes a simpler configuration and therefore has a lower manufacturing-cost.

BRIEF DESCRIPTION OF THE DRAWINGS

The novelty aspects which are considered as characteristic of the present invention will be established with reference to the attached claims. However, the invention itself, together with other of its objects and advantages will be better understood as per the following detailed description of each of the specific modalities of the same when read and compared to the attached drawings which include the following:

FIG. 3 is an elevated lateral view of the carrier shown in FIG. 2.

FIG. 4 is a sectional view which shows the configuration of the flexible projections which receive and hold the bottle neck.

DETAILED DESCRIPTION

Figure 1:
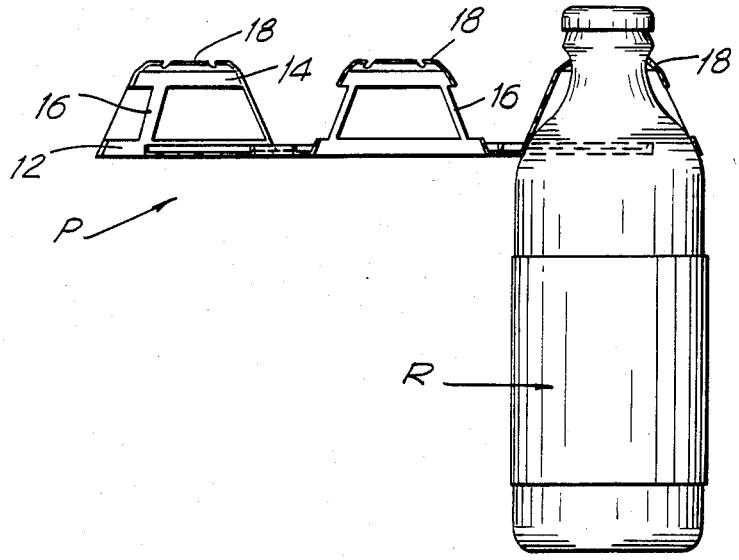
FIG. 1 is an elevation view of the carrier with represents the present invention.
Figure 2:
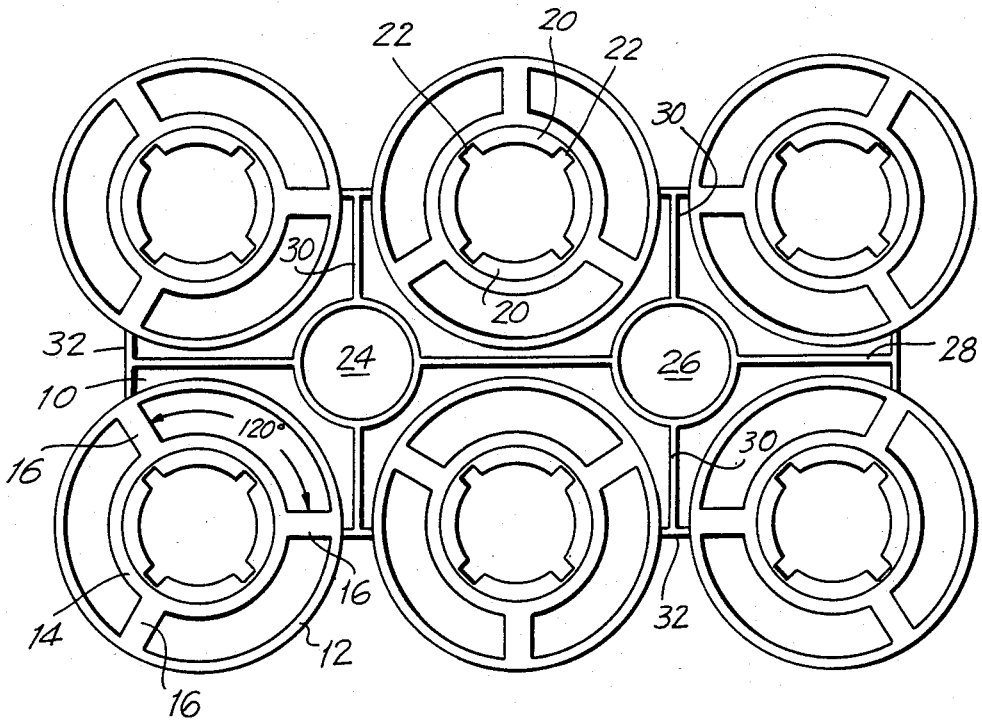
FIG. 2 is a plan view of the carrier of the present invention seen from its top part.

With reference to the drawings wherein the similar components are designated by the same reference numbers through the different figures, a P carrier made up of semi-rigid plastic material, adapted to support several receptacles or bottles R, usually in groups of six. Each bottle is hold by its neck and shoulder independent from each other. The carrier P generally includes: a support framework 10, which includes a series of rings 12, which are arranged in opposing pairs and are integrated on the edge of the aforementioned framework 10, and in effect form the openings to hold the shoulder of the bottles R. Another series of rings 14, of a smaller diameter (one for each ring 12) are located in the upper part of the rings 12, through which the neck of the bottle is inserted. A series of bands 16, which connect each one of the rings 12, with the rings of a smaller diameter 14, forming among the same a rigid structure. The cited bands 16, are positioned separately one from the other at an angle of approximately 120°.

The rings 14, also include a series of flexible projections 18, on their top part, out of the body of the same, which project diagonally upwards at approximately an angle of 30° . The cited projections 18, include at least four semicircular supporting tabs 20, with a separation between each one of them 22, to receive and hold the neck bottle. The configuration of the said projections 18, not only firmly hold the receptacles R, when they are inserted into the carrier P, but also, permit the easy removal of any receptacle R, from the carrier P.

Now making special reference to the supporting framework 10, which includes: a pair of finger openings 24, 26, which have a circular shape and through the use of which the carrier P, can easily be transported. A principal rib like structure 28, placed at the center and along the supporting framework 10, and a rib like structure 30, along the width of the same, and which coincide on the edge of each one of the openings 24 and 26, increasing the strenght of the carrier P, and lessening the thickness of the same. A lateral rib like structure 32, joining each one of the rings 12, which in effect constitute the edge of the cited framework 10.

As can be better seen in FIG. 1, the ring 12, holds the middle of the receptacle or bottles R, and the top ring 14, receives and holds the neck bottle, preventing, with this type of arrangement, lateral movement or wobbling of the receptacles R, when being transported.

Figure 5:
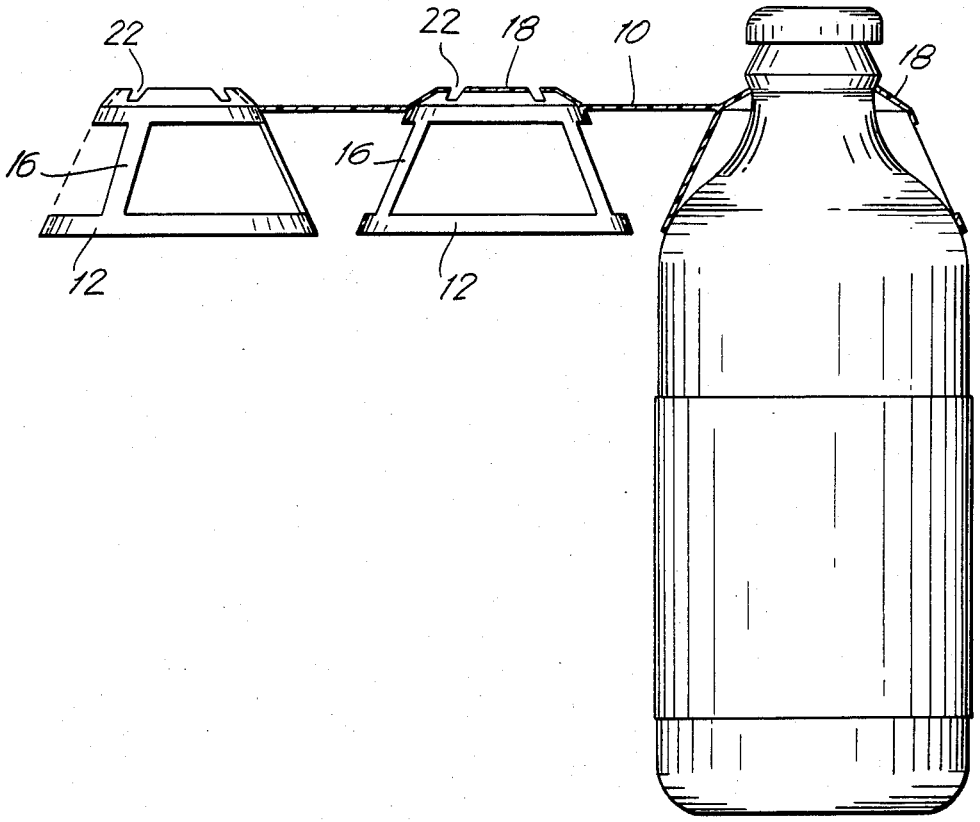
FIG. 5 is another elevation view of a second modality of the present invention.
Figure 6:
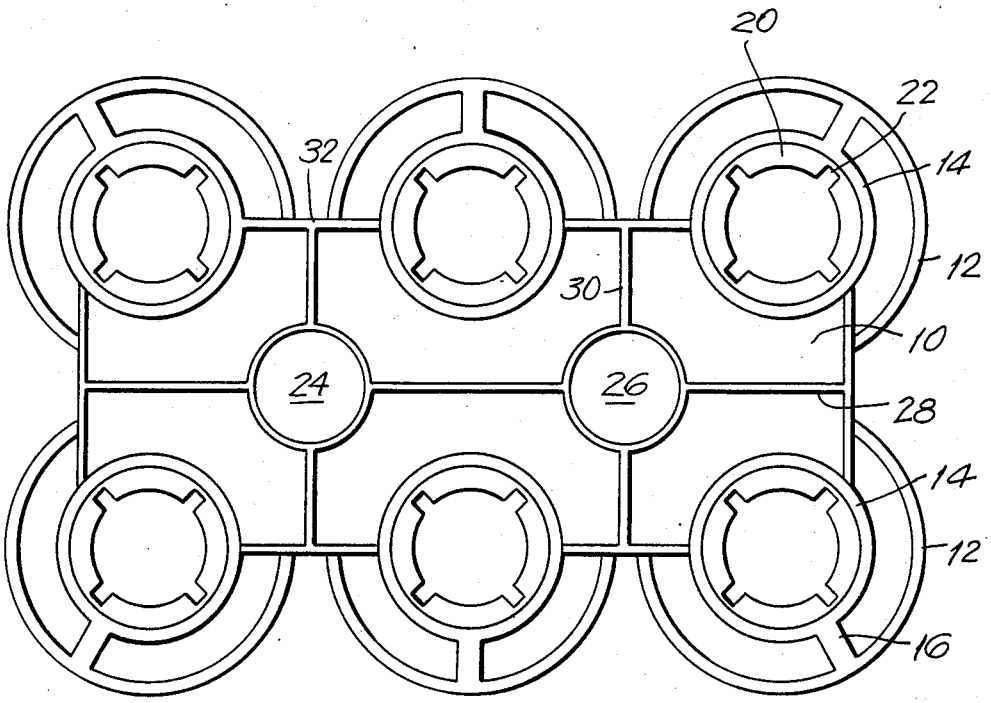
FIG. 6 is another plan view of the carrier shown in FIG. 5.

Now, making reference to FIGS. 5 and 6, a second modality of the carrier of the present invention is presented. This modality shows a similar arrangement as is shown in FIG. 1, with the exception that in this case, the supporting framework 10, is interconnected with the top rings 14.

Even though the carrier P, has been shown to carry six bottles it should be understood that the invention can be manufactured to carry any number of bottles and therefore it should be clear that the described carrier above includes specific modalities of the same to illustrate the invention and the experts in the field are trained to make the design and distribution changes that might the necessary. However, it should be understood that these design changes remain within the spirit and scope of the invention which are included in the following claims.

I claim:

1. A plastic carrier adapted to receive and hold a plurality of containers comprising:

a flat plate having a plurality of circular apertures adapted to surround shoulders of the containers in order to maintain the containers spaced from each other, said flat plate including a pair of finger receiving openings, and further including:

a circular wall extending upwardly and surrounding each circular aperture;

ribs provided on said flat plate in order to increase its resistance to bending and lessen the weight of said carrier;

at least three bands extending upwards from each circular wall;

an upper ring connected with each circular wall through said bands, and, forming an opening to receive the neck of a container; and, a plurality of container supporting tabs protecting upwards from the upper contour of each ring in order to retain each container by its neck.

2. The plastic carrier of claim 1, wherein the container supporting tabs are flexible tabs which extends upwards to a diameter less than the diameter of the upper ring.

* * * * *